US005520396A

United States Patent [19]

Therrien

[11] Patent Number: 5,520,396

[45] Date of Patent: May 28, 1996

[54] MAGNETIC GAME OR PUZZLE AND METHOD FOR MAKING SAME

[76] Inventor: Joel M. Therrien, 14 Moroney Rd., Grafton, Mass. 01519

[21] Appl. No.: 427,376

[22] Filed: Apr. 24, 1995

[51] Int. Cl.[6] ..... A63F 9/08

[52] U.S. Cl. ..... 273/288; 273/156

[58] Field of Search ..... 273/156, 157 R, 273/288, 290, 291, 239

[56] References Cited

U.S. PATENT DOCUMENTS

| | | | |
|---|---|---|---|
| 1,100,549 | 6/1914 | Elkins | 273/299 X |
| 4,138,115 | 2/1979 | Gans | 273/156 X |
| 4,326,720 | 4/1982 | Erlich | 273/239 |
| 4,861,039 | 8/1989 | Phillips et al. | 273/239 |
| 5,211,403 | 5/1993 | Ostrander | 273/288 X |

FOREIGN PATENT DOCUMENTS

| | | | |
|---|---|---|---|
| 450254 | 4/1968 | Switzerland | 273/146 |

*Primary Examiner*—William E. Stoll
*Attorney, Agent, or Firm*—Hoffman, Wasson & Gitler

[57] ABSTRACT

An amusing puzzle made up of a plurality of cube-shaped pieces, which form a unitary cube when the puzzle is properly solved. Each puzzle piece contains at least one permanent two-pole magnet which, when the puzzle is properly solved, is attracted to the corresponding pole of the magnet contained within the adjoining puzzle piece, thereby holding the puzzle pieces together in order to form the unitary cube.

12 Claims, 5 Drawing Sheets

MAGNETIC GAME OR PUZZLE AND METHOD FOR MAKING SAME

BACKGROUND OF THE INVENTION

1. Field of the Invention

This invention pertains to magnetic amusement puzzles or games, which require both skill and dexterity to successfully solve the puzzle or win the game.

2. Discussion of the Prior Art

Throughout time there have been various types of toys, games and puzzles having individual pieces which contain magnets. Examples of such prior art toys, games and puzzles are disclosed in the following U.S. patents.

U.S. Pat. No. 3,655,201 to Nichols shows a pattern-forming puzzle comprising eight cube-type pieces. Each piece includes an exposed surface and a non-exposed surface, the unexposed surfaces each contain a magnet 28. The magnets 28 are adapted to releasably engage with the non-exposed surfaces of similar cubes. The pieces form a cube-type shape when properly assembled.

U.S. Pat. Nos. 4,886,273 and 5,127,562 to Unger illustrate a combination breakable toy and puzzle, comprising eight identically-shaped elements, each having a hollow interior. The hollow interiors contain a magnet for interaction with magnets contained on the interiors of other shaped elements.

U.S. Pat. No. 3,601,921 to Strohmaier discusses a magnetic toy or building block comprising hollow top and bottom parts and magnets. The magnets are contained in the parts and supported in such a manner that the opposite magnet ends are of the same polarity adjacent to the opposite faces of the block.

U.S. Pat. Nos. 2,939,243 and 3,254,440 to Duggar disclose a set of magnetic toy building blocks. Each wall of the toy building blocks carries a permanent bar-type magnet. The blocks 10 may be assembled into various desired arrangements.

U.S. Pat. No. 3,184,882 to Vega shows magnetic toy blocks. Within the center of each of six faces of the blocks a one-piece permanent magnet element is carried. The blocks may be magnetically attached in any of numerous relative positions.

As it can plainly be seen however, the prior art patents are all complex to handle and expensive to make.

SUMMARY OF THE INVENTION

Accordingly, it is an object of the present invention to provide an amusing puzzle or game device that is fun to assemble.

It is another object of the present invention to provide an amusing puzzle or game device that is economical and inexpensive.

It is a further object of the present invention to provide an amusing puzzle or game device involving permanent magnets embedded below the surface of the playing pieces.

It is an additional object of the present invention to provide an amusing puzzle or game device involving permanent magnets embedded in the playing pieces wherein the magnetic field of the permanent magnets is directed in one direction outwardly from the surface of the playing pieces.

The novel features of the instant puzzle or game, together with further objects and advantages, will be better understood from the following description when considered in connection with the accompanying drawings. However, it is expressly understood that each of the drawings is given for the purpose of illustration and description only and not intended as a definition of the limits of the instant invention.

DETAILED DESCRIPTION OF THE PREFERRED EMBODIMENT

Figure 1:
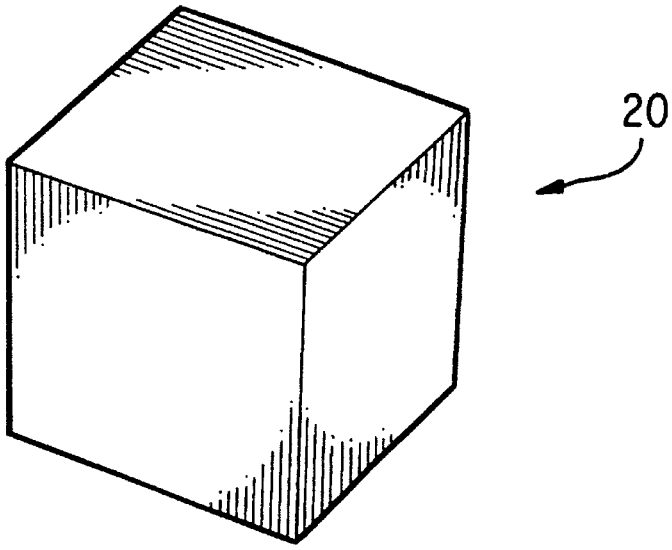
FIG. 1 shows a blank puzzle or game piece.
Figure 2:
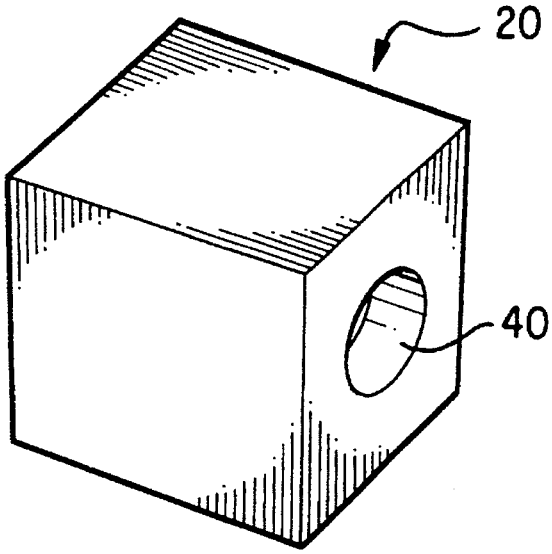
FIG. 2 shows a puzzle or gamepiece.

The preferred embodiment of the instant puzzle or game will now be set forth with reference to the drawing FIGS. 1–10.

Figure 3:
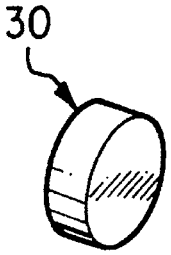
FIG. 3 shows a permanent magnet used in the game or puzzle.
Figure 4:
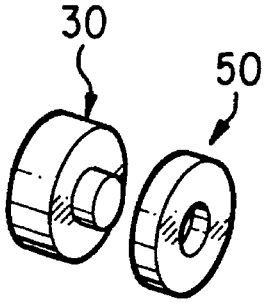
FIG. 4 is a game or puzzle piece and its associated ferrous metal keeper element.
Figure 5:
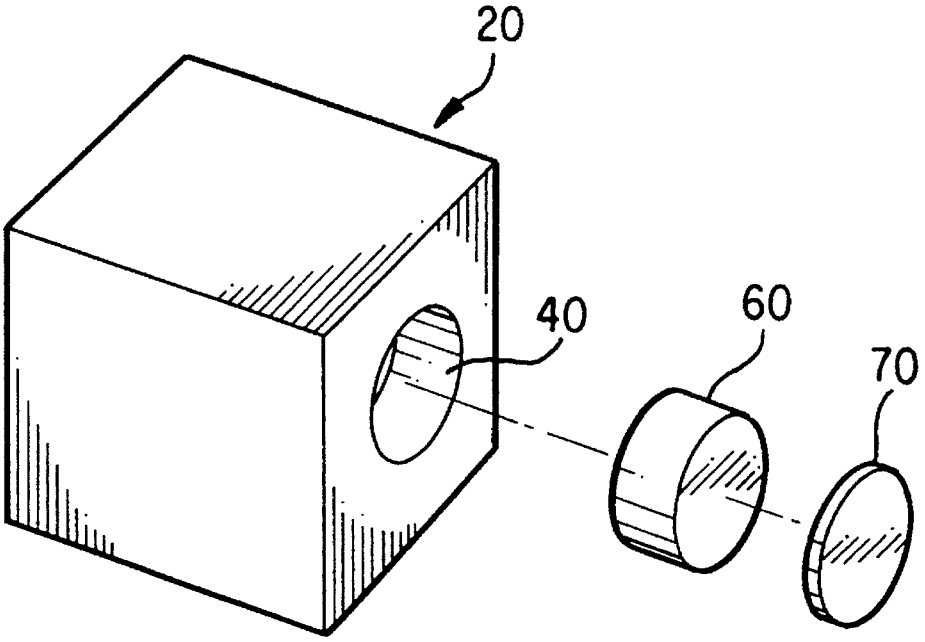
FIG. 5 shows an exploded view of a puzzle or gamepiece.
Figure 11:
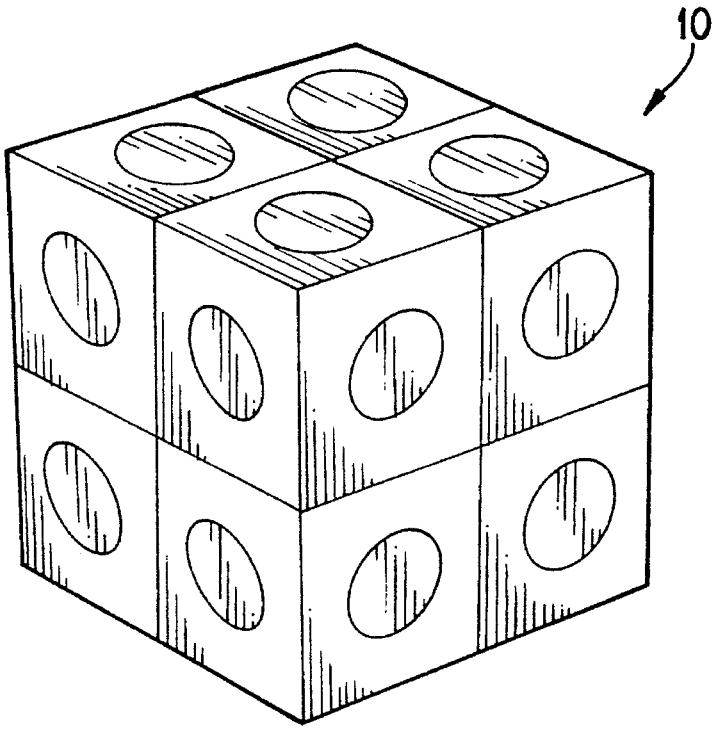
FIG. 11 shows an elevational view of the properly assembled puzzle or game.

Reference numeral 10, as shown in FIG. 11, is the properly and completely solved puzzle. The puzzle is made up of individual pieces designated as 20. A representative puzzle or gamepiece 20 is shown in FIG. 1. Permanent magnets 30, shown in FIG. 3, are contained within each puzzle piece 20, and will be discussed in greater detail later.

Figure 10:
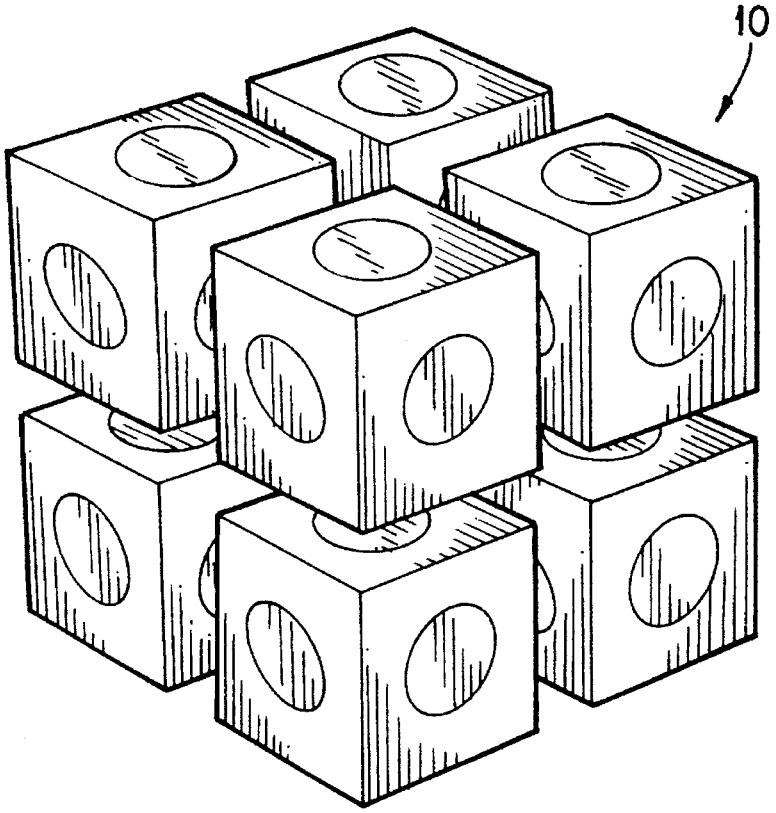
FIG. 10 shows an exploded view of the puzzle or game with the pieces positioned in a stand-apart arrangement.

FIG. 10 clearly shows how the various pieces 20 of the game or puzzle are magnetically attracted to one another to form a cube, when the puzzle is properly solved. The lines of magnetic attraction, which lines are formed based upon the well known principles of repulsion and attraction, serve to bind the puzzle pieces 20 together thereby forming the cube 10. However, as can readily be understood, if the puzzle is not properly solved, the puzzle pieces 20 will be magnetically repulsed, while the incorrectly oriented puzzle piece 20 will be pushed away.

Applicant emphasizes that, although a cube-shape is shown in FIGS. 10 and 11, and depicted and discussed hereinafter, almost any geometrically regular shape will produce an equally entertaining and amusing result, according to Applicant's invention. Hence, a pyramid shape or a solid parallelepiped, etc., each made up of individual, similarly-shaped smaller pieces, which themselves take the form of regular geometric shapes, function equally as well as cubes, for the purpose of practicing Applicant's game or puzzle. So, in other words, each of the individual puzzle pieces 20 must take the form of a geometrically regular solid whose faces are all of the same geometric shape, such that the edges, and overall dimensions of the faces must be congruent, thus of all the same length. Moreover, all faces of the puzzle or gamepieces 20 must be planar in nature and cannot include curved surfaces. Accordingly, any geometric solid shape conforming to these qualifications will maximize the number of possible orientations in which the puzzle or gamepieces 20 can physically be engaged with the other puzzle or gamepieces 20. Needless to say, if any face of a puzzle or gamepiece was of a different shape than its neighboring puzzle or gamepiece 20, the player would be able to visually deduce which side of the game or puzzle piece 20 did in fact contain a magnet.

Figure 7:
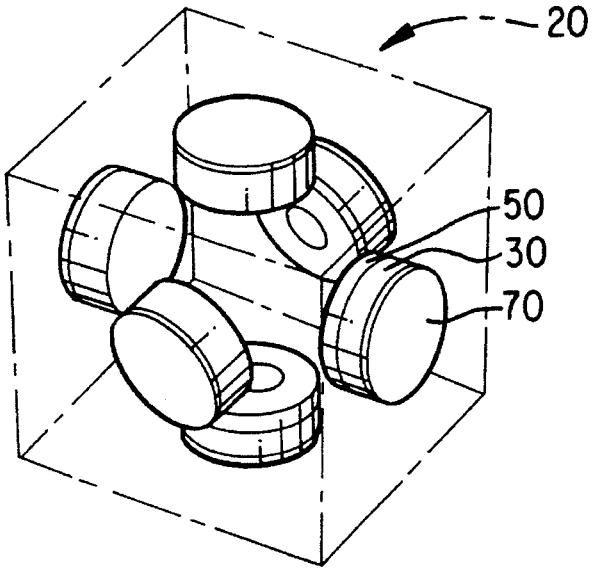
FIG. 7 shows a phantom view of the interior of a puzzle piece revealing the position of the magnets and the polar orientation of same.

The location and orientation of the permanent magnets 30 held within the puzzle pieces 20 are clearly shown in FIG. 7. Applicant has found that permanent magnets each having cylindrical cross-sections work best, due to the relative low cost and ease of incorporation into the individual puzzle pieces 20.

The permanent magnets 30 are each positioned along the center of at least three faces of the puzzle pieces 20, such that the lines of magnetic flux for each magnet 30 are directed outwardly, and almost linearly, from the true center of the puzzle piece 20.

It should be noted here that for the faces of the playing pieces 20 that do not contain a magnet 30, hereinafter referred to as "dead-faces", there will be no magnetic attraction nor magnetic repulsion, with respect to another playing piece regardless of whether or not the adjacent face of the other playing piece 20 contains a magnet 30. In other words, in order to derive the maximum amount of amusement, fun and enjoyment from the instant game or puzzle 10, the magnets 30 need only be placed in the face of the puzzle pieces 20 that will be magnetically engaged with another puzzle piece 20 when in the solved state.

Now, it must be emphasized that in order for the maximum amusement and enjoyment to be obtained from Applicant's game or puzzle 10, it is essential that the poles of the magnet pieces 30 are oriented toward the ends of the magnet pieces, that is to say, that the north pole is one end of the magnet, while the south pole is aligned towards the other end of the magnet.

An essential component and feature of the puzzle or game 10 centers around the structure and arrangement of the magnets 30 that are embedded in the pieces. Discussion of the magnets will now be made in detail with reference to FIGS. 3 and 4.

FIG. 3 shows the magnets 30 themselves are all two-pole and of the permanent magnet type and have, in the preferred embodiment, a circular cross-section. However, it is well within the contemplation of the Applicant that other shaped magnets may be useful and effective, such as a bar magnet, so long as the magnet used meets the basic requirements of being two-pole and permanent.

Concerning the two-pole requirement, it is essential that one pole of each of the magnets used in the pieces 20 lay in an orientation towards one end of the magnet, while the other pole lay in an orientation towards the other end of the magnet. In other words, the pole should lay in an orientation along the longitudinal axes of the magnet.

Keeping in mind the conventional rules concerning the properties of permanent magnets, the magnets 30 used in Applicant's puzzle or gamepieces 20 are provided with an annular shaped, ferrous metal keeper element 50, alternately referred to hereinafter as a keeper, which serves to concentrate and direct that influence of the field of the magnet 30 in a particular direction. The direction to which the keeper 50 directs the magnetic field is chosen and designated by Applicant to be outwardly from the face of the piece 20 in which the magnet 30 is placed. Thus, the keeper 50 serves to contain the field given off by its associated magnet, so as not to allow that field to stray towards another face, or otherwise interfere with the behavior of other magnets housed in the piece 20.

Figure 13:
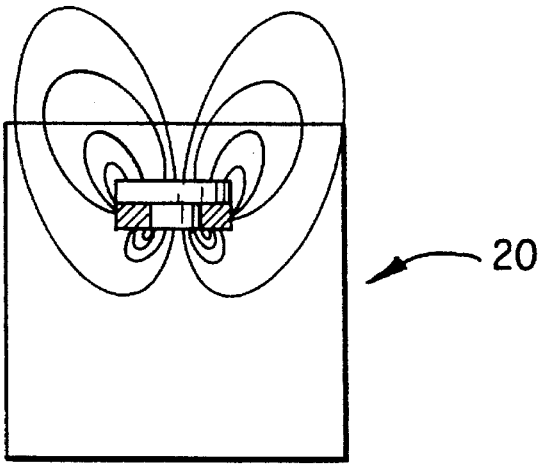
FIG. 13 shows magnetic lines of force emanating from Applicant's puzzle piece.

With reference to FIG. 13, the keeper 50 serves to concentrate the strength of the field given off by its associated magnet, thereby increasing the overall attractive or repulsive strength of the magnet 30, which in turn improves the holding capacity of one piece 20 for another, which in turn enhances the overall pleasure and enjoyment of the puzzle or game 10.

Figure 14:
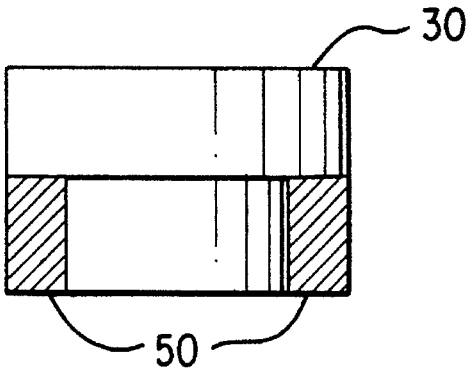
FIG. 14 shows a cross-sectional view of the magnets used in Applicant's puzzle pieces.

In the preferred embodiment, as shown in FIG. 14, the keeper 50 fits over one end of the magnet 30 such that a portion of the magnet 30 is seated in and passes through the annular opening of the keeper 50. It can readily be seen in FIG. 4 that a portion of the magnet must be removed in order to fit through the annular opening of the keeper. The overall dimensions of the keeper 50 must generally conform to the shape of the magnet 30 that it is associated with. The keeper 50, by virtue of the fact that it comprises a ferrous metal will remain in position against the magnet 30 due to the simple and well known attraction of ferrous metals to magnets. However, Applicant has found that a suitable adhesive or cement advantageously improves the retention of the keeper 50 on the magnet 30.

Figure 6:
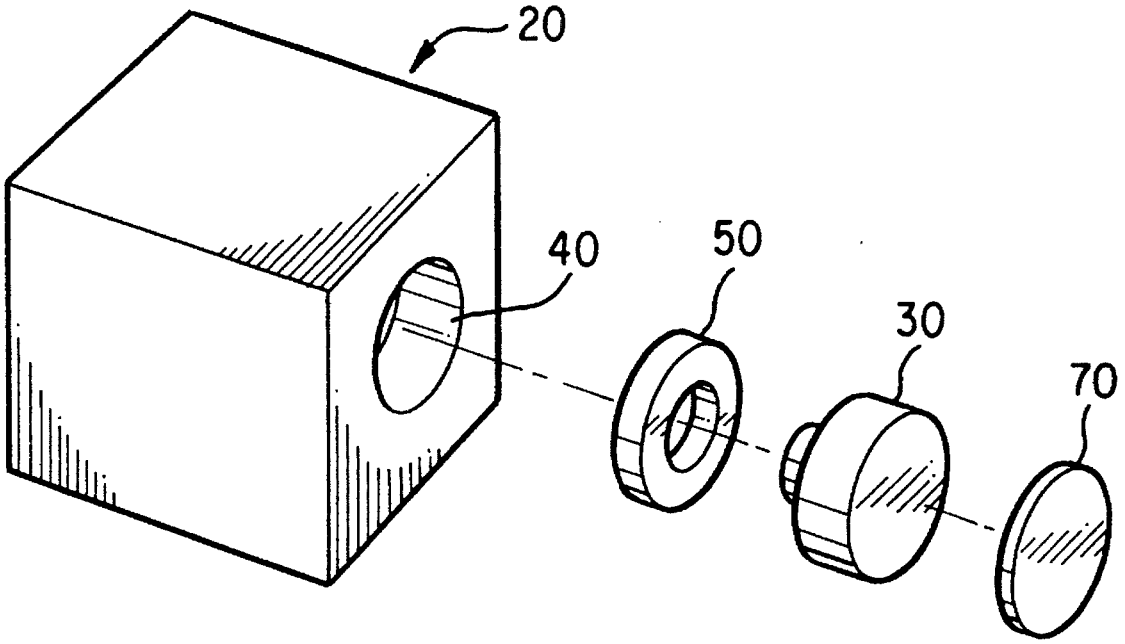
FIG. 6 shows an exploded view of a puzzle or gamepiece.

Concerning the orientation of the magnet 30 and keeper 50 combination in the face of the puzzle or gamepieces 20, Applicant has found that the magnet 30 should be oriented in the piece 20 such that the magnet pole holding the keeper 50 should be located deep into the hole 80 on the face, such that the other pole is closest to the surface of the face of the piece 20 as shown in FIG. 6.

An applique or decal 70 can then be applied to the pole of the magnet 30 that is closest to the surface of the face of the piece 20.

The discussion of the proper orientation of the poles toward the respective ends of the magnet piece can best be explained by reference to FIG. 8 and FIG. 9.

Figure 8:
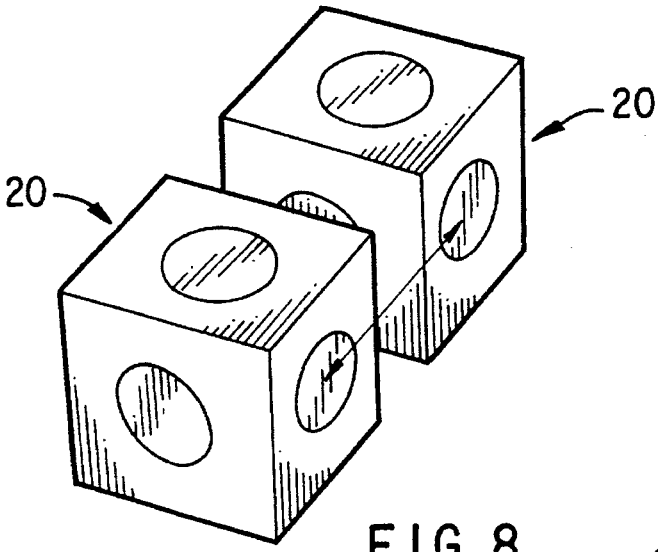
FIG. 8 is a diagrammatic representation of two puzzle pieces in the attraction mode.

FIG. 8 shows how the puzzle pieces 20 are repelled from one another, in accordance with the well known principles of physics, due to the fact that the magnetic piece contained in the adjoining faces of each of the puzzle pieces encounter a pole of similar polarity of either North-North, or South-South.

Figure 9:
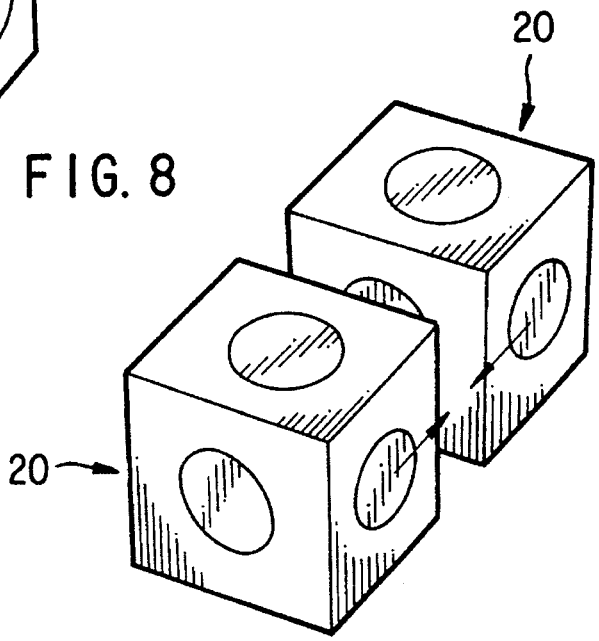
FIG. 9 is a diagrammatic representation of two puzzle pieces in the repulsion mode.

Whereas FIG. 9 demonstrates the manner in which the puzzle pieces are attracted to one another, also in accordance with the well known principles of physics, because the polarity of the magnet contained with the adjacent faces of the respective puzzle pieces is dissimilar, in North-South orientation or vice versa.

The method of making the individual game or puzzle pieces 20 will now be set forth in detail.

The construction of each piece 20 begins with the creation of a "blank", which actually forms the body of the puzzle piece 20. The blank can be made of any suitable substance, or material such as wood, molded thermoplastic, hard rubber, etc., so long as the substance or material is easy to work with and relatively inexpensive.

Next, the blank is drilled to a depth greater than the overall thickness of the permanent magnet 30 and its associated ferrous metal keeper element 50. It is essential for the maximum pleasure and enjoyment to be derived from the puzzle or game 10, that all faces of the puzzle pieces 20 be drilled in this manner. That is because, in order to maximize the number of possible arrangements in which the puzzle pieces can form the desired shape of the solved puzzle and yet be magnetically repulsed, all faces of the pieces must appear to be identical. The purpose of this goal is to make the puzzle or game as difficult as possible to solve.

After all the faces have been drilled out, and a decision is made as to which faces of the pieces will in fact not contain a magnet 30, filler plug 60, which can also be referred to as a "dummy magnet" or a "false magnet" is inserted in the now drilled-out hole 40. It is imperative that the plug 60 is then covered with an applique or decal 70 so as to have the same overall appearance as a real magnet, which will be inserted in the hole 40 provided on the other face or faces of the game pieces 20.

The final step in the making of each gamepiece 20 is to cover the face of the hole into which the magnet has been inserted with an applique, decal or the like 70, suitable for disguising and concealing the visual appearance of the magnet within the surface of the piece. The applique or decal 70 must have the same appearance as the earlier-mentioned filler-plug 60 so that a uniform look is given to all surfaces of the pieces 20, thereby further enhancing the difficulty of solving the puzzle. Note that the applique or decal 70 applied to the face containing a magnet 30 should be relatively thin and transparent to magnetic fields. Suitable material could perhaps be paper or a fabric, or perhaps a non-ferrous metal such as aluminum. In fact, any material meeting the criteria of being thin and transparent to magnetic fields would allow the puzzle or game to function as intended. The selection of what material to use is a matter of personal preference, so long as the field given off by the magnet contained in the face of the piece is not disturbed. In fact, decorative colors or attractive indicia may be used to further enhance enjoyment of the puzzle or game.

The remaining holes 40 will then be filled with an all important magnet 30. But before a magnet is inserted into its hole, it is necessary that the magnet be fitted with a keeper 50. In order for this to happen properly, the necessary shaping of the magnet 30 must occur. Shaping of the magnet 30 can be done in any of the well known manners and ways in which a magnetic material is shaped, exactly which manner chosen depending upon any number of factors which are not critical to the practice of this invention.

Next, the keeper 50 is placed on the magnet 30 as previously discussed, after which the magnet/keeper combination is seated in its hole 40. An adhesive can be used to hold the magnet/keeper combination in place in the hole 40.

The applique or blank 70 is held in place by a suitable adhesive or cement, although the applique or decal may be self-adhesive in any reliable form.

Turning now to FIG. 14, a clear cross-sectional view of the keeper/magnetic combination is shown. The keeper 50 is fitted onto the magnet 30 as demonstrated here, and efficiently and economically desirably directs the field produced by the magnet 30, as shown in FIG. 13.

Figure 12:
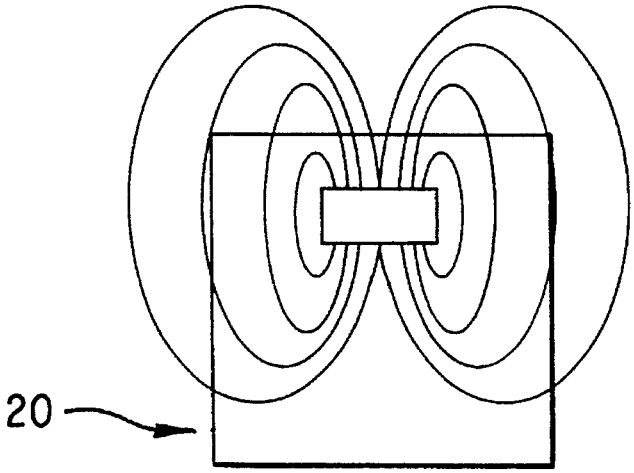
FIG. 12 shows magnetic lines of force emanating from a conventional puzzle piece.

FIG. 12 shows a puzzle or gamepiece incorporating a conventional magnet. The lines of force from the magnet contained within the piece spread outside the piece, even through the sides, in an uncontrolled manner, while Applicant's pieces 20 incorporate a magnet/keeper combination wherein the magnetic lines of force are concentrated through one face of the piece.

While the preferred embodiment and alternate embodiments of the present invention have been shown and described, it will be understood by those skilled in the art that changes and modifications may be made without departing from the invention in its broader aspects. Therefore, the aim in the appended claims is to cover all such changes and modifications as fall within the true spirit and scope of the invention, as presented.

I claim:

1. An opaque, unitary, cube-shaped game or puzzle playing piece, including an annular ferrous metal element and at least one solid, cylindrically shaped, two-pole permanent magnet, said permanent magnet being centrally embedded near the surface of at least one face of said playing piece, said permanent magnet disposed within an opening conforming to the dimensions of said magnet, the first pole of said permanent magnet being embedded in said opening so as to project the field of magnetic influence emanating from said first pole in a direction extending outwardly from said face, said annular ferrous metal element being adapted for location around said second pole of said permanent magnet of a location partially extending along a linear axis of said permanent magnet, whereby the field of magnetic influence emanating from said first pole is concentrated by said ferrous metal element.

2. The unitary cube-shaped game or puzzle playing piece of claim 1, wherein said annular ferrous metal element is attached to said second pole of said permanent magnet by an adhesive cement.

3. An opaque unitary cube-shaped game or puzzle playing piece including two permanent magnets centrally embedded near each of two surfaces respectively, of said playing piece, each of said permanent magnets being disposed within an opening in said surface respectively, each of said permanent magnets having first and second poles, the first pole being disposed to project its field of magnetic influence emanating from said pole in a direction projecting outwardly from the respective face of the playing piece, each permanent magnet including an annular ferrous metal element adapted for location over the second pole respectively, whereby said field of magnetic influence emanating from each of said respective first pole is concentrated by said ferrous metal element.

4. The unitary cube-shaped game or puzzle playing piece of claim 3, wherein each of said annular ferrous metal elements is attached to the second pole of each of the respective permanent magnets by an adhesive cement.

5. An opaque unitary cube-shaped game or puzzle playing piece including three permanent magnet centrally embedded near each of three surfaces respectively of said playing piece each of said permanent magnets being disposed within an opening in said surface each of said permanent magnets having first and second poles, the first pole being disposed to project its field of magnetic influence emanating from said pole in a direction projecting outwardly from the respective face of the playing piece, each permanent magnet including an annular ferrous metal element adapted for location over the second pole respectively, whereby said field of magnetic influence emanating from each of said respective first pole is concentrated by said ferrous metal element.

6. The unitary cube-shaped game or puzzle playing piece of claim 5, wherein of said annular ferrous metal element is attached to the second pole of each of the respective permanent magnets by an adhesive cement.

7. The opaque unitary cube-shaped game or puzzle playing piece of claim 5, wherein said playing piece is magnetically transparent.

8. The opaque, unitary cube-shaped game or puzzle playing piece of claim 5, wherein each face of each playing piece is provided with a circularly shaped, magnetically transparent, in-laid decorative element, said decorative element adaptive to seal, respectively, one of said opening into which said permanent magnet is disposed, whereby said decorative element effectively conceals the presence of said permanent magnet embedded thereunder.

9. An amusement game or puzzle, the object of the game or puzzle being the formation of a unitary geometric shape, the game or puzzle comprising a plurality of opaque, unitary, cube-shaped playing pieces, each of said playing pieces, respectively, including at least one solid, cylindrical permanent magnet having first and second poles, said magnet disposed in a centrally located depression in one face of said playing piece, said depression conforming to the shape of said magnet, the depression containing said magnet being covered by a decorative magnetically transparent applique so as to conceal the presence of said magnet, said magnet disposed so as to project form one of its poles a field of magnetic influence in a direction outward from the respective face of said playing piece, said second pole being surrounded by an annular ferrous metal element, said element extending partially along the longitudinal axis of said magnet, said element secured to said second pole by cement, whereby said field of magnetic influence emanating from said first pole is concentrated by said element.

10. The game or puzzle of claim 9, wherein said first pole of any of said playing pieces magnetically interacts with the first pole of at least one other playing piece, said first pole of said one other playing piece being of opposite magnetic polarity to said first pole, whereby a first playing piece is magnetically captivated by at least one other playing piece.

11. The game or puzzle of claim 10, wherein each face of said playing piece is provided with a decorative applique, said applique positioned centrally upon said face, so as to provide a uniform appearance for each playing piece.

12. A method of making an opaque, unitary, cube-shaped game or puzzle playing piece, comprising at least one solid, cylindrical permanent magnet having first and second poles, an annular ferrous metal element surrounding the second pole of said magnet, and a decorative applique applied to one face respectively of said playing piece, the method comprising the steps of:

boring an opening at the planar center on one side of said playing piece, to a depth less than the major distance to the center of said playing piece, said opening having dimensions corresponding to the diameter of said magnet;

seating said magnet within said borehole at a depth equal thereto, said first pole disposed nearest the surface of said borehole; and sealing said borehole with said applique.

* * * * *